US005257589A

United States Patent [19]

Forstpointner

[11] Patent Number: 5,257,589

[45] Date of Patent: Nov. 2, 1993

[54] OVERCASTING MACHINE FOR USE IN SEWING INSOLES TO UPPERS

[75] Inventor: Peter Forstpointner, Munich, Fed. Rep. of Germany

[73] Assignee: J. Strobel & Sohne GmbH & Co., Munich, Fed. Rep. of Germany

[21] Appl. No.: 878,922

[22] Filed: May 6, 1992

[30] Foreign Application Priority Data

May 7, 1991 [DE] Fed. Rep. of Germany ..... 4114920

[51] Int. Cl.[5] ..... D05B 15/02; A43D 65/00

[52] U.S. Cl. ..... 112/28; 112/20; 112/162; 12/4.1

[58] Field of Search ..... 12/4.1; 112/28, 50, 112/20, 162, 51, 62, 47

[56] References Cited

U.S. PATENT DOCUMENTS

| | | | |
|---|---|---|---|
| 1,625,633 | 4/1927 | Thero | 112/162 X |
| 2,292,762 | 8/1942 | Kucera . | |
| 2,370,547 | 2/1945 | Kniessler . | |
| 2,730,056 | 1/1956 | Wiesenfeld | 112/20 |
| 3,046,920 | 7/1962 | McCann | 112/162 X |
| 4,098,202 | 7/1978 | Marforio et al. | 112/20 |
| 4,901,656 | 2/1990 | Yoshida . | |

FOREIGN PATENT DOCUMENTS

| | | |
|---|---|---|
| 1922505 | 11/1970 | Fed. Rep. of Germany . |
| 2702258 | 5/1978 | Fed. Rep. of Germany . |

*Primary Examiner*—Clifford D. Crowder
*Assistant Examiner*—Paul C. Lewis
*Attorney, Agent, or Firm*—Bacon & Thomas

[57] ABSTRACT

An overcasting machine for use in sewing mated insoles to uppers with gathering of the uppers relative to the insoles is disclosed wherein a step-wise driven advance disk engages the uppers and an undriven pressure disk engages the insoles at a nip area between the disks, which are spring-loaded towards each other. The advance disk drives the material of the uppers which in turn at least in part drives the material of the insoles in an advance direction during sewing. A blade is provided which extends into the nip area between the advance and the pressure disks in order to slightly separate the uppers from the insoles so that mutual slippage between them and resulting gathering of the uppers is made possible. To improve the gathering operation, the blade is selectively moveable into various operational positions so that, depending on the properties of the uppers and of the insoles, the blade can project more or less towards and beyond the gap at the nip area in the direction of advance of the uppers and insoles.

6 Claims, 4 Drawing Sheets

OVERCASTING MACHINE FOR USE IN SEWING INSOLES TO UPPERS

BACKGROUND OF THE INVENTION

The present invention generally pertains to an overcasting machine for use in sewing insoles to uppers.

Overcasting machines, also often referred to as "overhand sewing", "oversewing", "over-edge sewing" or "overseam sewing" machines, which function to sew insoles to shoe uppers, for example, when manufacturing reversed shoes or shoes wherein the tread is molded or vulcanized onto the insole sewn to the upper, are known in the art as exemplified by German patent No. 1,922,505.

In such prior art machines, an advance disk and a pressure disk are arranged to form a nip, so that the advance disk is driven step-wise and engages the uppers during sewing, while the pressure disk rests against the mated insole material. The advance disk thus drives the material of the upper which in turn at least partially frictionally drives the material of the insole, which engages the freely rotating pressure disk. The pressure disk is spring-loaded towards the advance disk by means of movable support arm rotatably supporting the pressure disk. A tapered blade is used to slightly separate the upper material from the insole material and is movable in the direction of advance of the upper and the insole into a gap at the nip area between the advance disk and the pressure disk, with the sharper edge of the blade pointing in the advance direction to vary the friction driving effect between the upper and insole material, and to produce a gathering of the upper relative to the insole. The blade is mounted on a lever pivotably supported on the machine housing and may be actuated manually, by a pedal or a positioning motor, and cooperates with a stop pin on the machine housing. The blade is adapted to be pivoted into its operational position wherein the lever rests against the stop pin. Then, during the sewing of an insole to an upper, the upper will be gathered, i.e. puckered, in order to compensate for extra width of the upper when sewing is performed along the insole toe and the toe of the upper.

Unfortunately, in such prior art overcasting machines, the blade has a single operating position so that the machine cannot effectively be used to sew diverse upper and insole materials.

SUMMARY OF THE INVENTION

The object of the present invention is to create an overcasting machine for sewing insoles to uppers which enables problem-free gathering of the uppers with uniform folding, especially when sewing along the insole toes and the toes of the uppers, and which can enable gathering of the uppers to any desired degree to accommodate the most diverse upper and insole materials.

The invention rests on the concept that gathering the uppers can be substantially improved provided that the blade serving to separate the uppers from the insoles is not always fixed in a single operational position. Instead, according to the invention, the position of the blade is made variable in relation to the properties of the upper and insole materials and the mutual behavior of the uppers and insoles when passing the advance and the pressure disks during sewing and is matched to these parameters. It has been discovered that outstanding results may be achieved when gathering the uppers during the sewing of the insoles to them in this fashion.

A preferred embodiment of the overcasting machine of the present invention for sewing insoles to uppers is illustratively described below with reference to the following drawings.

DETAILED DESCRIPTION OF A PREFERRED EMBODIMENT

Figure 1:
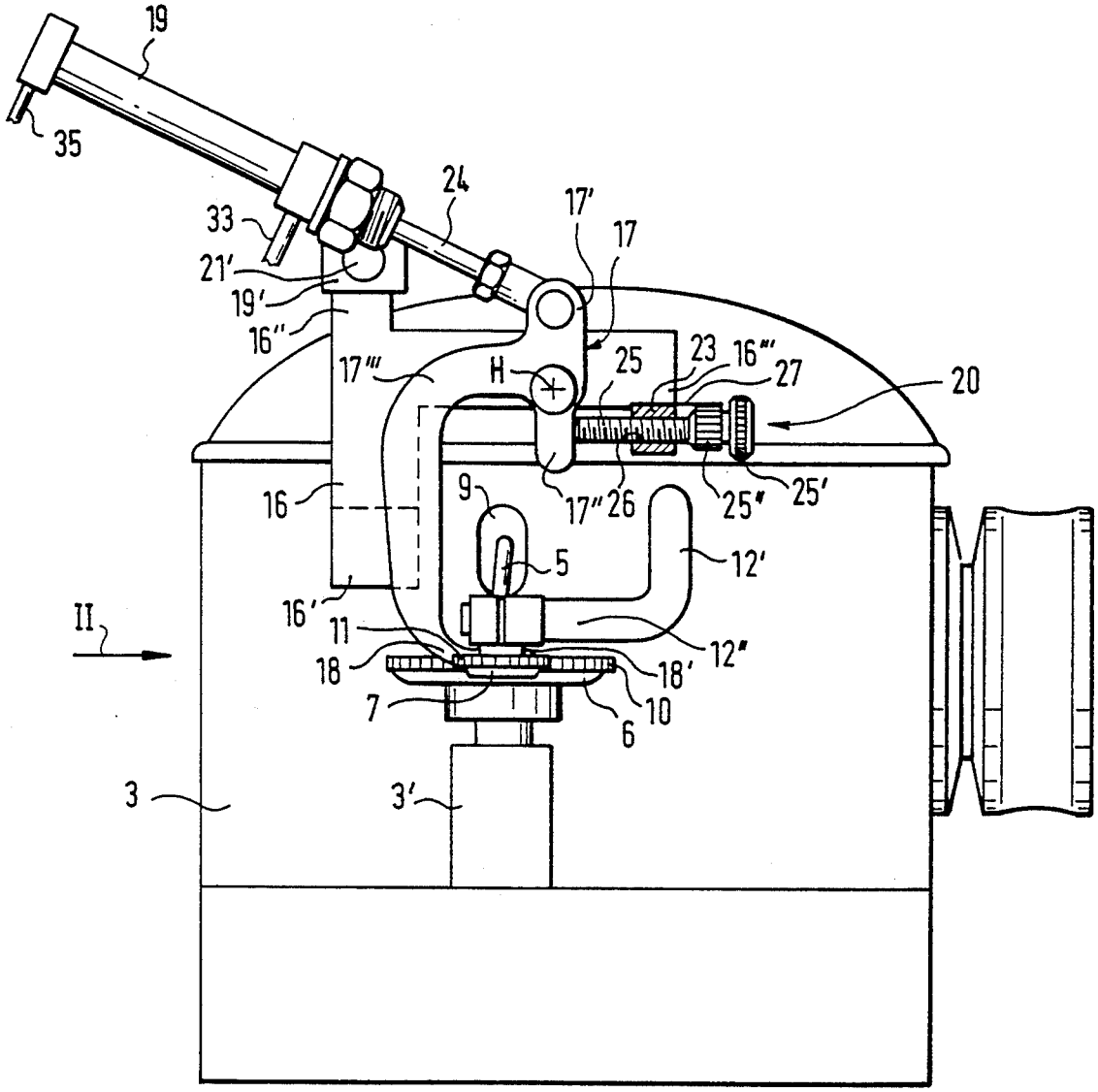
FIG. 1 is a front elevational view of the overcasting machine of the present invention.

The single-thread overcasting machine depicted is adapted for use in sewing an insole 1 to a mated upper 2, for example when making shoes wherein the insoles and uppers are sewn and then plastic treads are provided onto the insoles. Special steps are taken to gather the upper 2 when sewing the insole toe 1' to the toe 2' of the upper 2, which toe 2' is wider than the toe 1' of the insole 1. The amount of excess width depends on the particular shape of the shoe in the vicinity of the toe and is compensated for by this gathering.

The overcasting machine comprises a housing 3, a sewing needle 4, a gripper 5, an advance disk 6 and a pressure disk 7. The sewing needle 4 extends approximately horizontally and is affixed at the front end of a needle bar 8 projecting from the housing 3 at the front of the sewing machine. The gripper 5 passes through an aperture 9 in the housing 3. The advance disk 6 and the pressure disk 7 are mounted in the same horizontal plane directly underneath the sewing needle 4 and cooperate to form a nip area between the disk peripheries.

The advance disk 6 includes teeth 10 along its outer periphery and is mounted adjacent the front of the housing 3 upon a housing projection 3'. The pressure disk 7 also is provided with peripheral teeth 11 and is mounted adjacent advance disk 6 on the side of the disk 6 which is remote from the housing 3. More particularly, pressure disk 7 is mounted to a support arm 12 projecting from the housing 3 at the front side of the sewing machine. Support arm 12 is longitudinally shiftable within housing 3 and is spring-loaded toward housing 3 as will be more fully described herein. By means of a drive assembly (not shown), the advance disk 6 can be rotated step-wise. On the other hand, pressure disk 7 is rotatably mounted but lacks a corresponding drive assembly of its own.

The two respective vertical axes of rotation V and A of the advance and pressure disks 6 and 7 extend in the same plane, in which also the sewing needle 4 extends. The pressure disk support arm 12 extends parallel to this vertical plane and extends away from the housing 3, namely horizontally, then merges first into a section 12' bent downward at a right angle and then into a section 12'' in which, in turn, is bent at a right angle to the vertical plane. The free end of support-arm section 12'' carries another support to which the pressure disk 7 is rotatably mounted about axis A and which comprises an eccentric shaft 13. Shaft 13 extends upwardly and is received in a borehole 14 at the free end of the support-arm section 12'' wherein it is clamped by a screw 15 passing through a side slot 14' of the borehole 14.

A support 16 for a lever 17 having a blade 18, for a positioning motor 19 to actuate the lever 17 and for a stop 20 for the lever 17 is located on the front side of the sewing machine and will now be described in detail. The support 16 is affixed by a lower, orthogonally offset arm 16' to the housing 3 and comprises an upper, vertical arm 16'' and an upper horizontal arm 16'''. A bracket 19' connected to the positioning motor 19 is linked by a horizontal bolt 21, having a head 21', to the vertical arm 16''. Two fore-arms 22, 23 project horizontally from the horizontal arm 16''' on the side of arm 16''' which is remote from the housing 3. Lever 17 is pivotably mounted upon fore-arm 22 about a horizontal axis H and fore-arm 23 comprises part of the stop 20 as will be more fully discussed below. The lever 17 comprises three arms 17', 17'' and 17''' which extend radially from the axis of rotation H. The positioning motor 19 is pivotally connected to and acts on the upwardly extending arm 17'. In the preferred embodiment shown, positioning motor 19 is a dual-acting, compressed-air actuator having a piston rod 24 of which the free end is linked to the arm 17' so that rod 24 and arm 17' can be mutually pivoted about a horizontal axis.

The downwardly extending arm 17'' of lever 17 cooperates with motion stop 20. The stop 20 consists of a screw 25 which can be manually rotated by head 25' at an end away from the arm 17'' through a threaded hole 26 provided in fore-arm 23 of the support 16 and which is adapted to be positively restrained against rotation at various operating positions. For that purpose, the screw 25 is provided near the rotation head 25' with a circular array of circumferentially equidistant detent projections 25'' which cooperate with and engage a leaf spring 27 affixed to a top portion of fore-arm 23 of the support 16.

Figure 3:
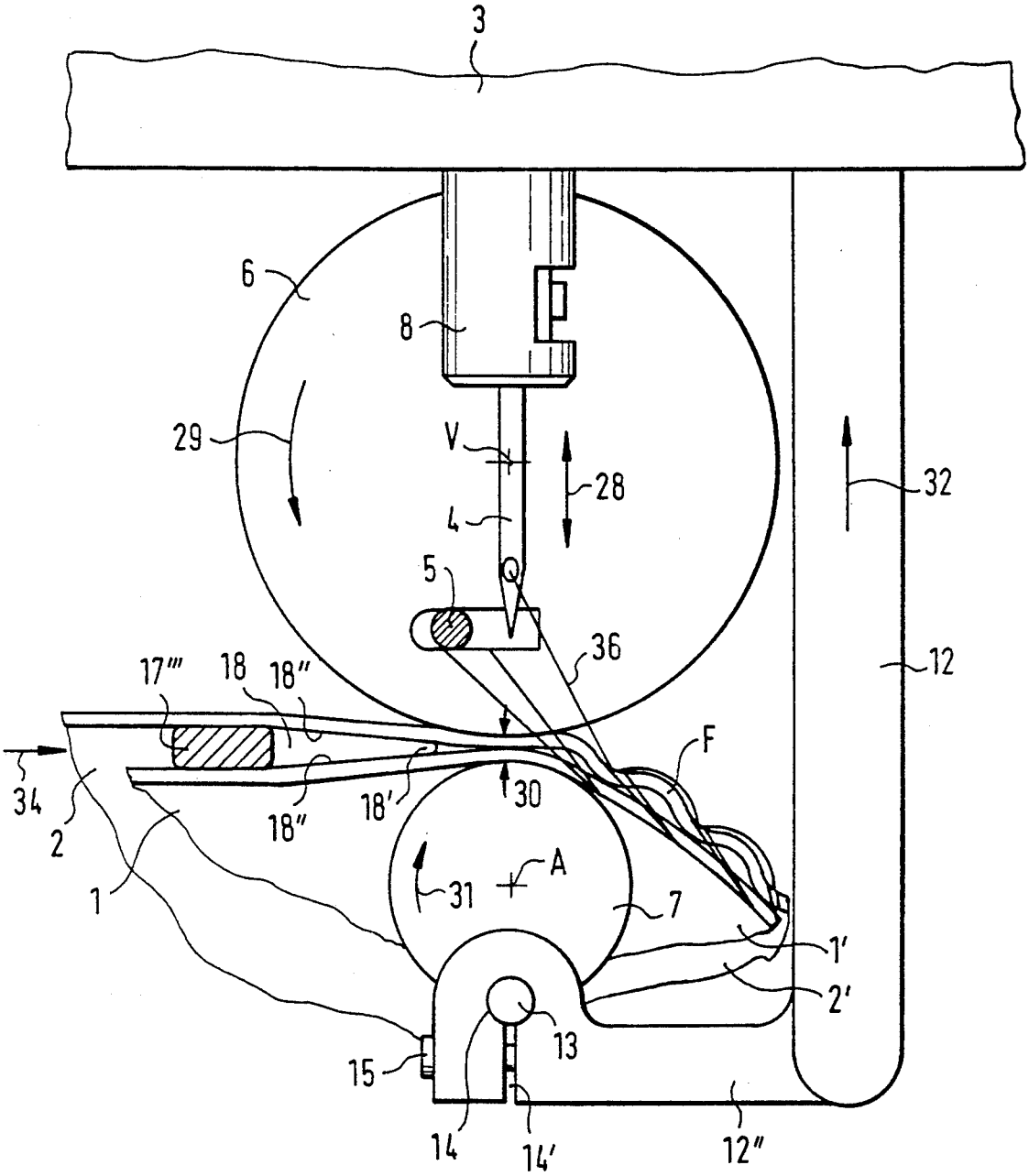
FIG. 3 is an enlarged top view of the overcasting machine as viewed in the direction of the arrow III of FIG. 2 with the blade used to separate the upper material from a mating insole material being positioned at its maximum distance away from the gap between the advance disk and the pressure disk.
Figure 4:
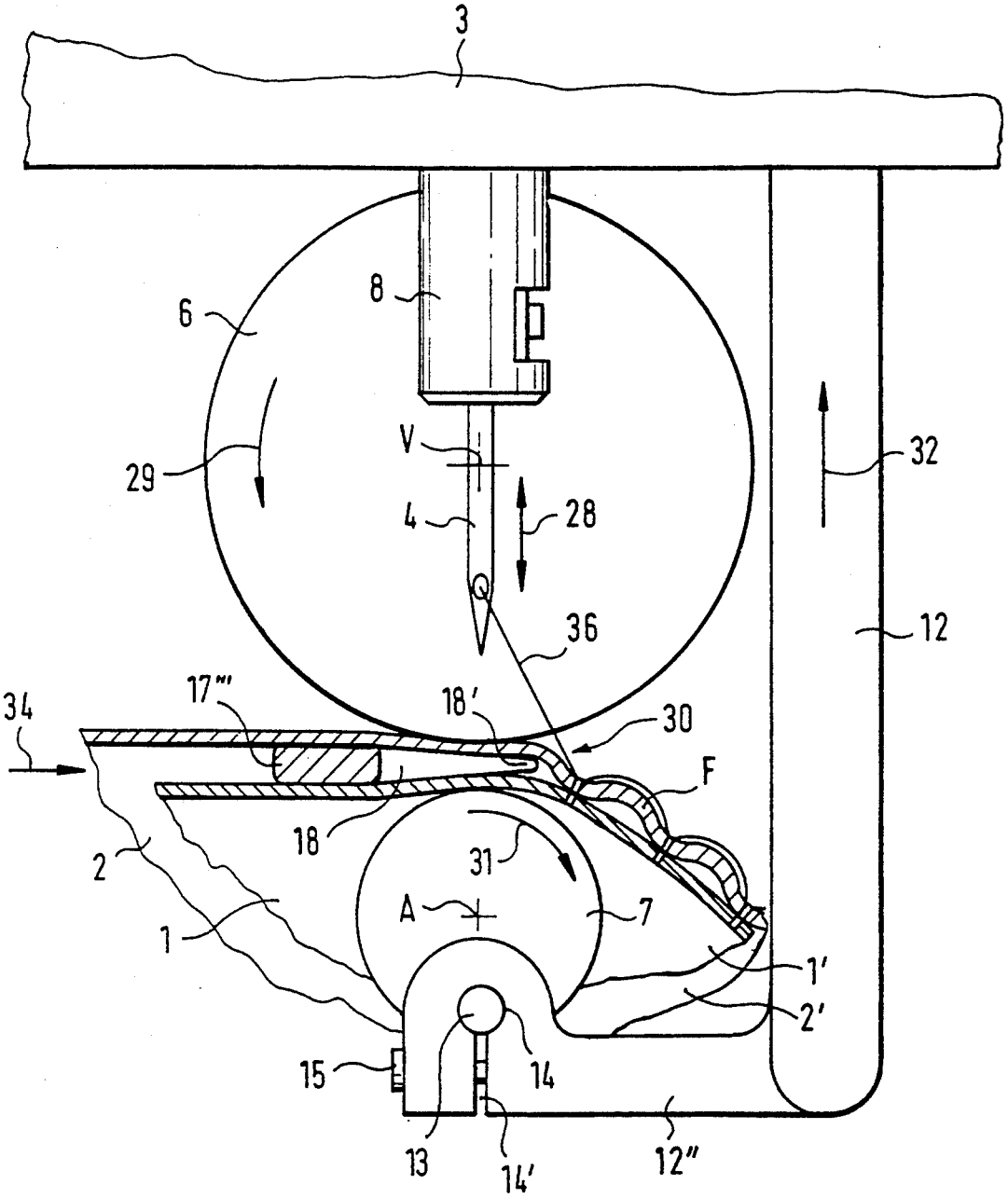
FIG. 4 is a top view corresponding to FIG. 3 showing the blade projecting to a maximum extent into the gap between the advance and pressure disks.

Laterally projecting arm 17''' of the lever 17 merges, by means of an essentially orthogonally bent section which is approximately parallel to the lower arm 17'', into the blade 18 facing the advance disk 6 and the pressure disk 7. Therefore, arm 17''' and blade 18 of the lever 17 are essentially C-shaped as shown in FIG. 1. As depicted in FIGS. 3 and 4, the blade 18 tapers conically from the arm 17''' of the lever 17 toward the free blade end 18' and the two side faces 18'' of the blade 18 converge toward end 18'.

Figure 2:
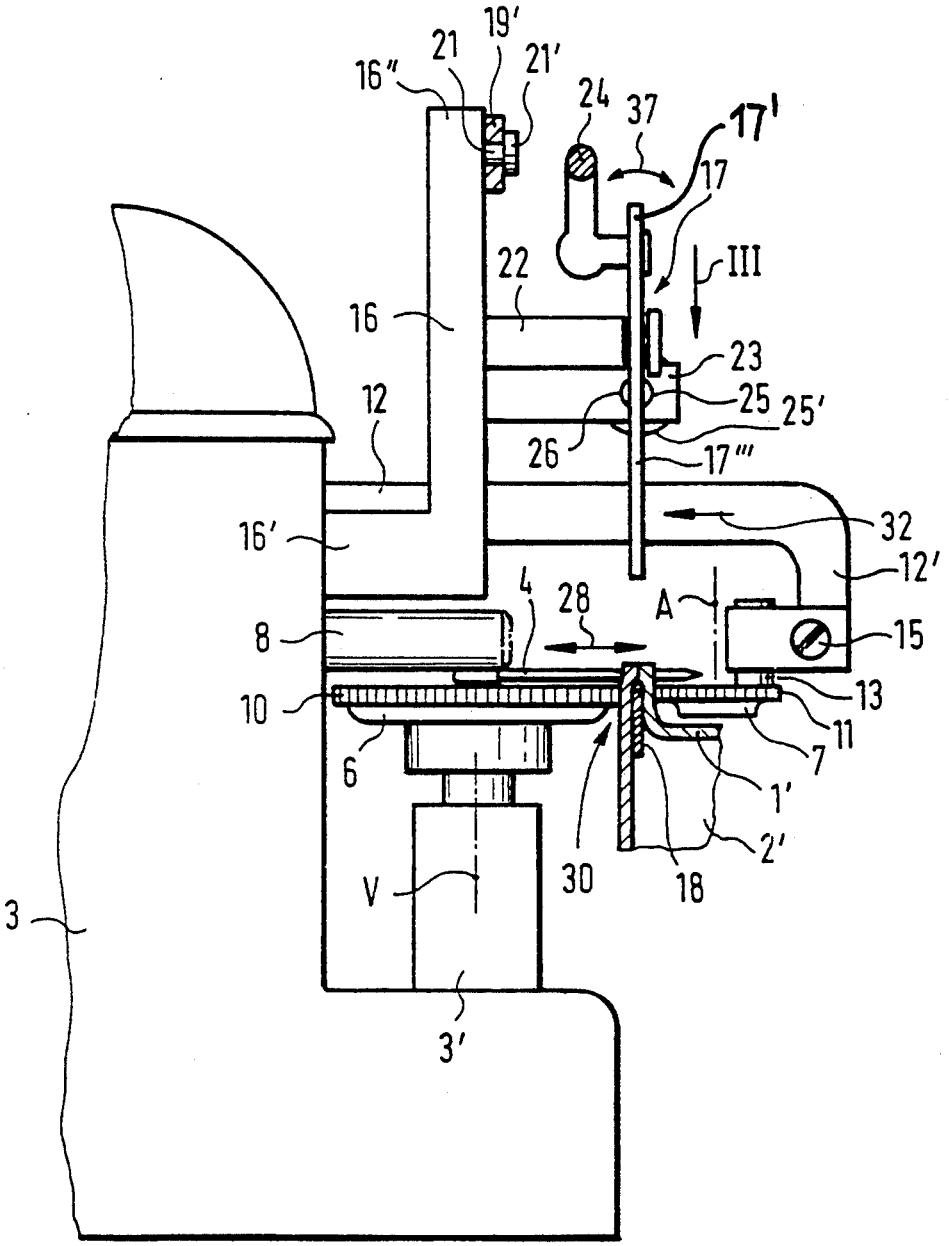
FIG. 2 is a side view of the overcasting machine as viewed in the direction of the arrow II of FIG. 1, with the overcasting machine being used in a sewing operation.

When sewing, the sewing needle 4 reciprocates in a plane containing the vertical axes of rotation V and A of the advance and pressure disks 6 and 7 respectively. The gripper 5 cooperates with needle 4 in a conventional manner in order to join, by an overcasting seam, a mated insole 1 and an upper 2 that are fed into the nip area between the advance and pressure disks 6, 7, respectively, and are displaced by the advance disk 6 as advance disk 6 is rotated step-wise, in the direction of arrow 29, in synchronization with the oscillation of sewing-needle 4 in the direction of double arrow 28 as shown in FIGS. 3 and 4. When passing through the gap 30 between the advance disk 6 and the pressure disk 7, the edges of the insole 1 and upper 2 project upward so as to be pierced by the sewing needle 4 as shown in FIG. 2. By means of its teeth 10, the advance disk 6 grips the upper 2 and forces it along. The upper 2, in turn, engages and forces along the insole 1 which, in turn, causes the pressure disk 7 to rotate in the direction of the arrow 31 in FIGS. 3 and 4. The pressure disk 7 is engaged through its teeth 11 with the insole 1 and is forced, by at least one spring acting on support arm 12 in the direction of the arrow 32 of FIGS. 2 through 4, toward the advance disk 6. In part, the insole 1 is dragged along by the upper 2 by means of the already formed overcasting seam and, in part, by friction depending on the coefficient of friction between the upper 2 and the insole 1 and on the pressure with which they contact each other between the advance disk 6 and the pressure disk 7.

In order to gather the toe 2' of the upper 2 when sewing the upper toe 2' to the toe 1' of the insole 1, blade 18 is moved into the gap 30 at the nip area between the advance disk 6 and the pressure disk 7 to separate the upper 2 from the insole 1 so as to permit relative slippage therebetween. The side faces 18'' of the blade 18 are exceedingly smooth and, as a result, the upper 2 and the insole 1 are able to readily slide along faces 18''. In general, upper 2 and insole 1 are able to slide on faces 18'' with far less friction than must be overcome for relative motion between upper 2 and insole 1 when directly lying one on the other.

When the insole toe 1' is being sewn to the toe 2' of upper 2, the positioning motor 19 is supplied, through a line 33, with compressed air to retract piston rod 24 so as to pivot lever 17 counter-clockwise about axis H (FIG. 1) until the lower arm 17'' of lever 17 comes to rest against the stop 20, i.e., the left end of the screw 25 in FIG. 1. The blade 18 in this process moves in the direction of advance of the upper 2 and insole 1 illustrated by the arrow 34 in FIGS. 3 and 4 into its operational position. After the insole toe 1' has been sewn to the upper toe 2', the blade 18 is moved back into its rest position by the positioning motor 19 being supplied, through another line 35, with compressed air to extend piston rod 24.

It is essential that the blade 18 be movable into different operational positions in the direction of advance (i.e. in the direction of arrow 34 shown in FIGS. 3 and 4) of upper 2 and insole 1. The particular operational position depends on the properties of the upper 2 and insole 1 and therefore can be correspondingly selected and adjusted using screw 25 of stop 20. For example, FIG. 3 depicts an operational position wherein blade 18 projects a minimum distance toward the gap 30 between the advance disk 6 and the pressure disk 7, whereas FIG. 4 depicts an operational position in which blade 18 projects a maximum distance into and beyond gap 30. Between these two extreme positions, the position of blade 18 is adjustable non step-wise (i.e., continuously) using screw 25 of stop 20. As a result of the adjustability of the position of blade 18 and on account of the tension in the sewing thread 36 illustrated in FIGS. 3 and 4, variable gathering of the upper 2 with variable upper folds F can be achieved.

It is also possible to provide a visual display of the particular operational position of blade 18 in any particular case. In this regard, it is possible to incorporate such a display arrangement as disclosed in German utility model registration No. 8 516 202. In general, it suffices for this purpose to connect the screw 25 of stop 20 through a potentiometer to a digital display for indicating the particular axial position of screw 25.

It should be understood that positioning motor 19 is not limited to a dual-acting compressed-air actuator. The lever 17 and blade 18 can also be operated directly by the sewing operator using a pedal or a knee lever, that is, without any positioning motor 19. Moreover, when a positioning motor 19 is in fact used, it can be controlled by a pedal or knee lever in order to permit the insole 1 and the upper 2 to be held by the sewing operator with both hands as generally required and to be guided toward the advance disk 6 and the pressure disk 7 when the blade 18 is being moved into its operational position to gather the upper 2.

To insert the mated insole 1 and the upper 2 between the advance disk 6 and the pressure disk 7, the support arm 12 of pressure disk 7 can be displaced against its spring loading, i.e. opposite to the direction of arrow 32 in FIGS. 2 through 4. This shifting of the pressure disk 7 from the advance disk 6 can be carried out in the same manner as already described with reference to the actuation of lever 17 which, by the way, could be made displaceable at the fore-arm 22 of the support 16 also in the direction of the double arrow 37 as shown in FIG. 2 in order to allow for different thicknesses of insoles and/or uppers.

As blade 18 is initially moved into its operational position towards the gap 30, the pressure disk 7 is shifted away from advance disk 6, and the sewing needle 4 is positioned as shown in FIG. 2. As soon as the blade 18 has assumed its operational position, the spring loading of the support arm 12 in the direction of the arrow 32 is effective again to force the pressure disk 7 toward the advance disk 6. This shifting motion does not take place to the same extent as the shifting motion used to insert the sewing material (insole 1 and upper 2) between the advance disk 6 and the pressure disk 7 and to remove the material from the overcasting machine. Advantageously, the tension of the sewing thread 36 is increased while the insole toe 1' is sewn onto the upper toe 2', that is, as long as blade 18 is in its an operational position at or between those shown in FIGS. 3 and 4.

Although described with respect to a preferred embodiment of the invention, it should be understood that various changes and/or modifications can be made to the present invention without departing from the spirit of the invention. In general, the invention is only intended to be limited by the scope of the following claims.

What is claimed is:

1. An overcasting machine for use in sewing insoles to uppers comprising:

a housing;

an advance disk and a pressure disk rotatably carried by said housing so as to form a nip area and a variable gap for receiving an insole and a mated upper to be sewn to each other, with the advance disk contacting the upper and the pressure disk contacting the insole;

means for rotatably driving said advance disk in a step-wise manner to drive said upper in an advance direction which in turn at least in part drives said insole in the advance direction;

means for biasing said advance and pressure disks towards each other to enable variation of said gap between the disks;

a blade movable in the advance direction of said insole and said upper and relative to said gap between said advance and pressure disks, said blade being adapted to extend in an operational position between said insole and said upper in the nip area so as to permit relative slippage between said insole and said upper when the advance disk is driven, and to thereby enable gathering of said upper relative to said insole; and means for adjusting the operational position of said blade relative to said gap so as to enable the blade to project towards and beyond the gap to a variable extent to vary the gathering of said upper relative to said insole, said adjusting means including a stop for positively limiting the movement of the blade, said stop being selectively adjustable to alter the operational position of said blade, wherein said stop comprises a manually operable screw threaded element adapted to engage a portion of said blade at said operational position, and means for restraining rotation of said screw threaded element at various set positions.

2. An overcasting machine as claimed in claim 1, wherein said screw threaded element includes detent means and said means for restraining rotation comprises a leaf spring adapted to positively engage said detent means to resist rotation of said screw threaded element.

3. An overcasting machine as claimed in claim 1, wherein said blade is conical in shape and tapers towards its end facing the nip area.

4. An overcasting machine as claimed in claim 1, further including remotely controllable means for moving said blade into said operational position.

5. An overcasting machine as claimed in claim 4, wherein said means for moving said blade comprises a positioning motor.

6. An overcasting machine as claimed in claim 1, comprising a movable support arm on which said pressure disk is rotatably mounted and wherein said means for biasing said advance and pressure disks towards each other includes means for urging said support arm to move the pressure disk towards said advance disk.

* * * * *